US005401019A

United States Patent [19]

Wissman et al.

[11] Patent Number: 5,401,019

[45] Date of Patent: Mar. 28, 1995

[54] ALL-IN-ONE GOLF TOOL

[76] Inventors: Thomas Wissman, 761 Corvette Dr., Largo, Fla. 34641; David Bielicki, 2093 Fairlane Dr., both of Largo, Fla. 34641

[21] Appl. No.: 138,412

[22] Filed: Oct. 15, 1993

[51] Int. Cl.[6] ..... A63B 57/00

[52] U.S. Cl. ..... 273/32 B; 33/555.2

[58] Field of Search ..... 273/32; 224/918, 919; 33/555.2

[56] References Cited

U.S. PATENT DOCUMENTS

| | | | |
|---|---|---|---|
| 3,310,879 | 3/1967 | Brzezlinski | 273/32 B |
| 3,828,442 | 8/1974 | Bernard | 33/555.2 |
| 4,063,731 | 12/1977 | Kitay | 273/32 B |
| 4,535,987 | 8/1985 | Dikoff | 273/32 B |
| 5,226,647 | 7/1993 | Notarmuzi | 273/32 B |

*Primary Examiner*—Mark S. Graham

*Attorney, Agent, or Firm*—Kane, Dalsimer, Sullivan, Kurucz, Levy, Eisele & Richard

[57] ABSTRACT

A golf tool having a variety of uses includes a circular hole for checking the roundness of a golf ball. The hole may also be partially obstructed to prevent a ball from passing through the hole. Such capability, together with a snap permitting the attachment of the tool to the shaft of a golf club, allows the tool to be used to retrieve a golf ball from an inaccessible position. The tool also has two fingers, whose moderately sharp ends may be used to clean the grooves on the face of the head of the golf club, and to repair ball marks on golf course greens. The tool may be struck into the ground in an upright position using these fingers, and a flattened portion on top used to keep the hand grip of a golf club off of wet grass. A slot on the tool may be used to hold a cigarette, when the tool is in such an upright position.

13 Claims, 4 Drawing Sheets

ALL-IN-ONE GOLF TOOL

BACKGROUND OF THE INVENTION

1. Field of the Invention

The present invention relates to recreational games and, more particularly, to the game of golf. Specifically, the invention is a tool having a variety of separate uses related to the playing of that game.

2. Background of the Invention

The game of golf is well known in the art, and that art is replete with inventions designed to help the player improve his game or, in the alternative and at the very least, to lessen the frustration which attends efforts to improve meeting only with failure. The present invention may be used to both of these ends, as it is a tool having a multiplicity of uses of interest to the experienced and beginning golfer alike.

SUMMARY OF THE INVENTION

The present invention is a tool intended for use by a golfer. The tool comprises only two parts, which may be molded together from a polymeric resin material, and assembled when the integrally molded and joined parts are ejected from an injection molding apparatus.

The tool, referred to as an "All-In-One Golf Tool" by its inventors, includes a circular hole having a diameter and a circumference substantially equal to those of a golf ball. Therein resides the first capability of the tool—to check the roundness or sphericality of a golf ball, either new or used.

The tool also has a snapping means permitting its temporary attachment to the shaft of a golf club, and a means for obstructing a portion of the circumference of the above-mentioned hole. Together, these features provide the tool with its second use—to retrieve a golf ball from the bottom of a water hazard or other relatively inaccessible position. This is accomplished by attaching the tool to the shaft of a golf club using the snapping means, and by engaging the means for obstructing a portion of the circumference of the hole, permitting a golf ball to be reached and cradled therein without falling therethrough.

The tool includes two fingers extending like the tines of a fork therefrom. The so-called snapping means may be incorporated between the fingers. The fingers may narrowingly taper to edges, the edges of the two finger preferably being aligned with one another. These edges give the tool its third and fourth uses—to clean the grooves in the face of a golf club by scraping dirt therefrom, and to repair ball marks on greens.

Finally, the side of the tool opposite the two fingers may be provided with a slot, and a substantially flattened portion. When the tool is stuck, fingers first, into the ground, the slot may be used to hold a cigarette, keeping it off the wet and possibly chemically treated grass, while the substantially flattened portion may be used as a rest for the handle grip of a club, so that it need not come in contact with the wet grass.

The present golf tool will now be described in more complete detail by making reference to the several drawing figures included herewith and identified below.

DETAILED DESCRIPTION OF THE PREFERRED EMBODIMENT

Figure 1:
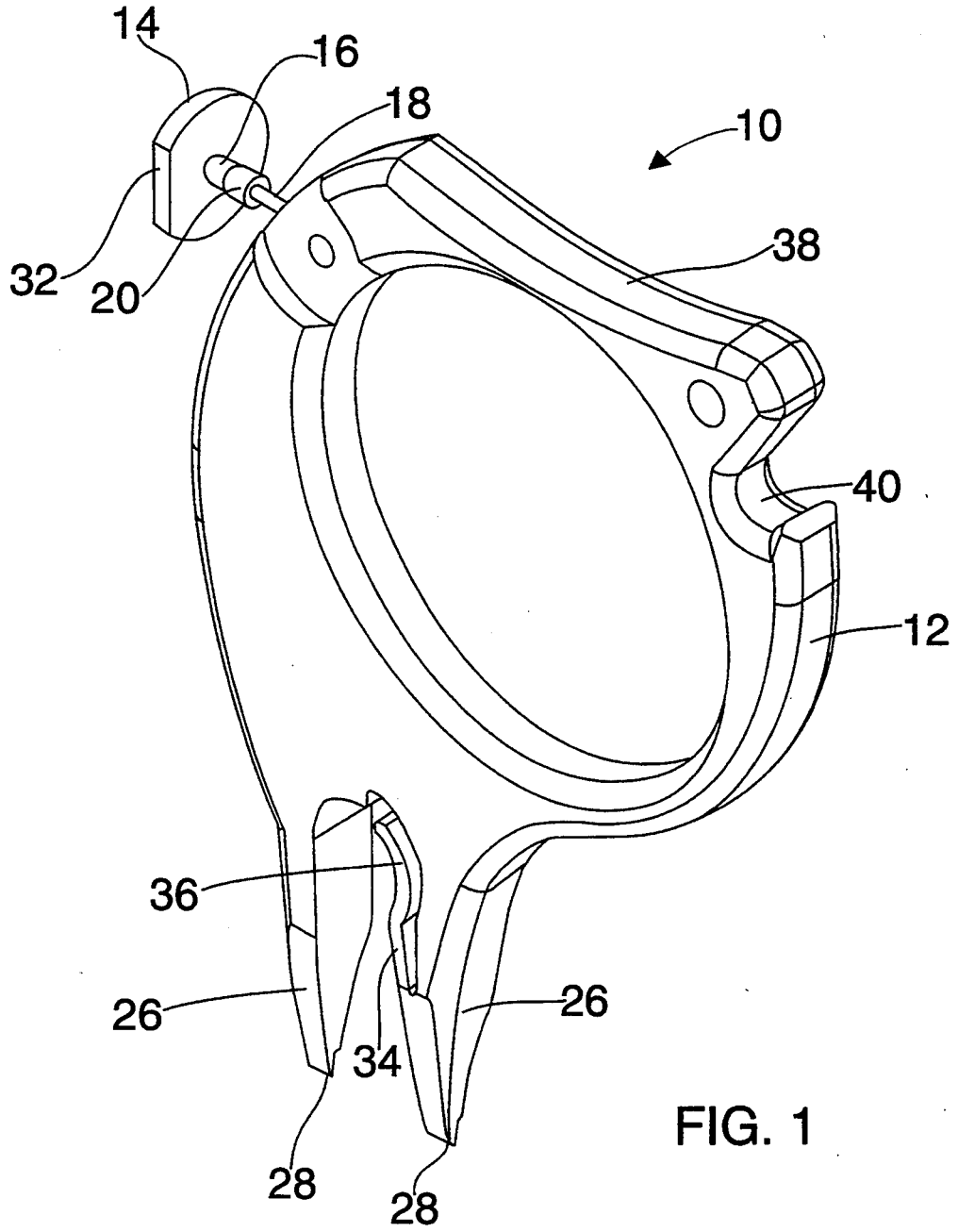
FIG. 1 is a perspective view of the tool of the present invention as molded and prior to assembly.

Referring first to FIG. 1, the golf tool 10 which comprises a plate-like body 12 and a button 14, these two pieces being molded together and having the appearance as illustrated when ejected from an injection molding apparatus. The button 14 has a post 16, and is connected to the plate-like body 12 by runner 18. The button 14 and plate-like body 12 are separated from one another by breaking runner 18, and assembled as shown in FIG. 2.

Figure 2:
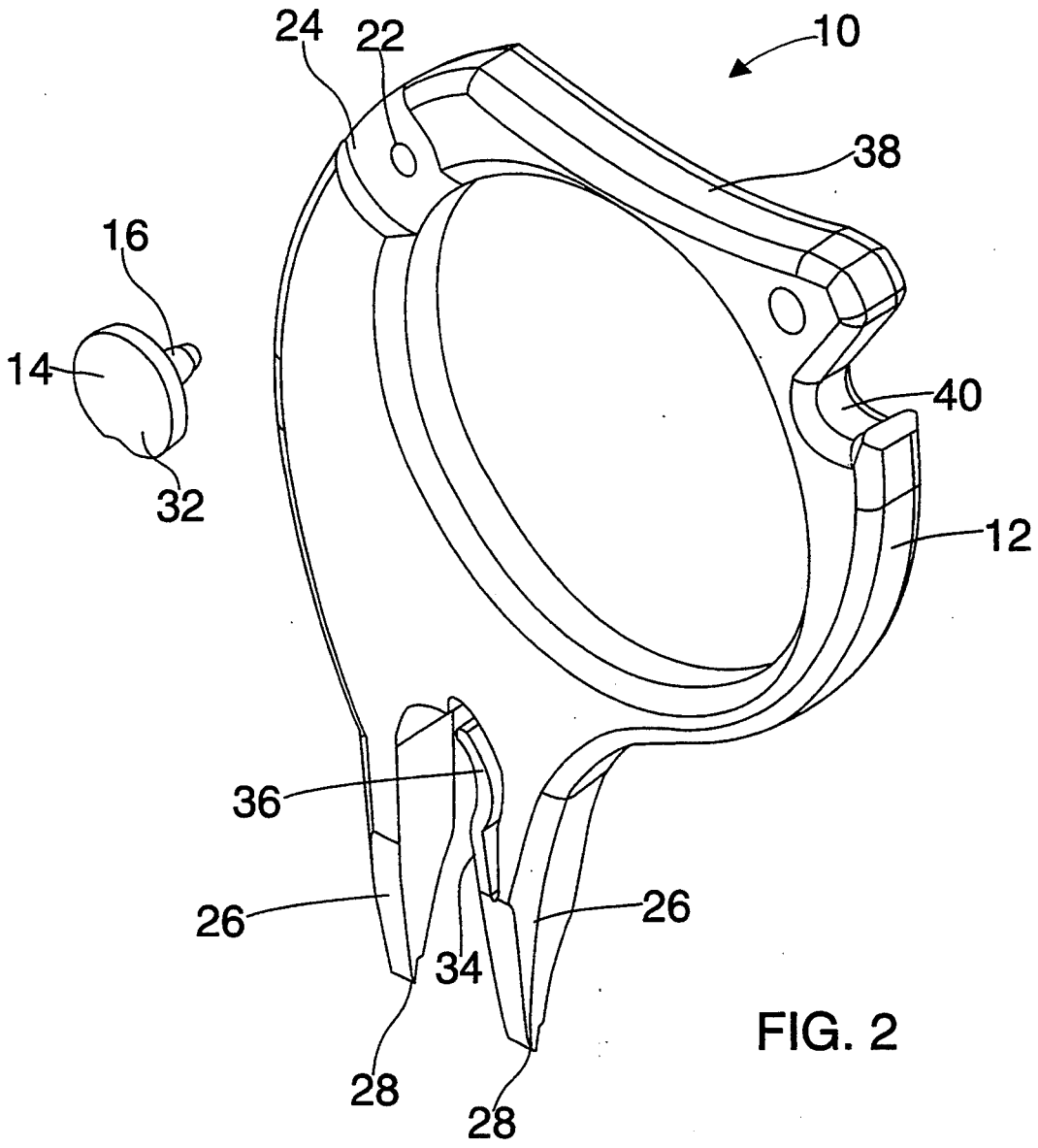
FIG. 2 is a perspective view of the tool showing its manner of assembly.

In FIG. 2, the button 14 is shown prior to assembly with plate-like body 12. The post 16 may have a portion 20 of enlarged diameter, which may be more readily observed in FIG. 1. In like manner, hole 22 in the plate-like body 12 may have a portion of reduced diameter, not shown in the figure, so that post 16 may be snappingly and permanently disposed therewithin to secure the button 14 to the plate-like body 12. A recess 24 may be provided in the plate-like body 12, so that the button 14 may be even with the surface thereof.

Figure 3:
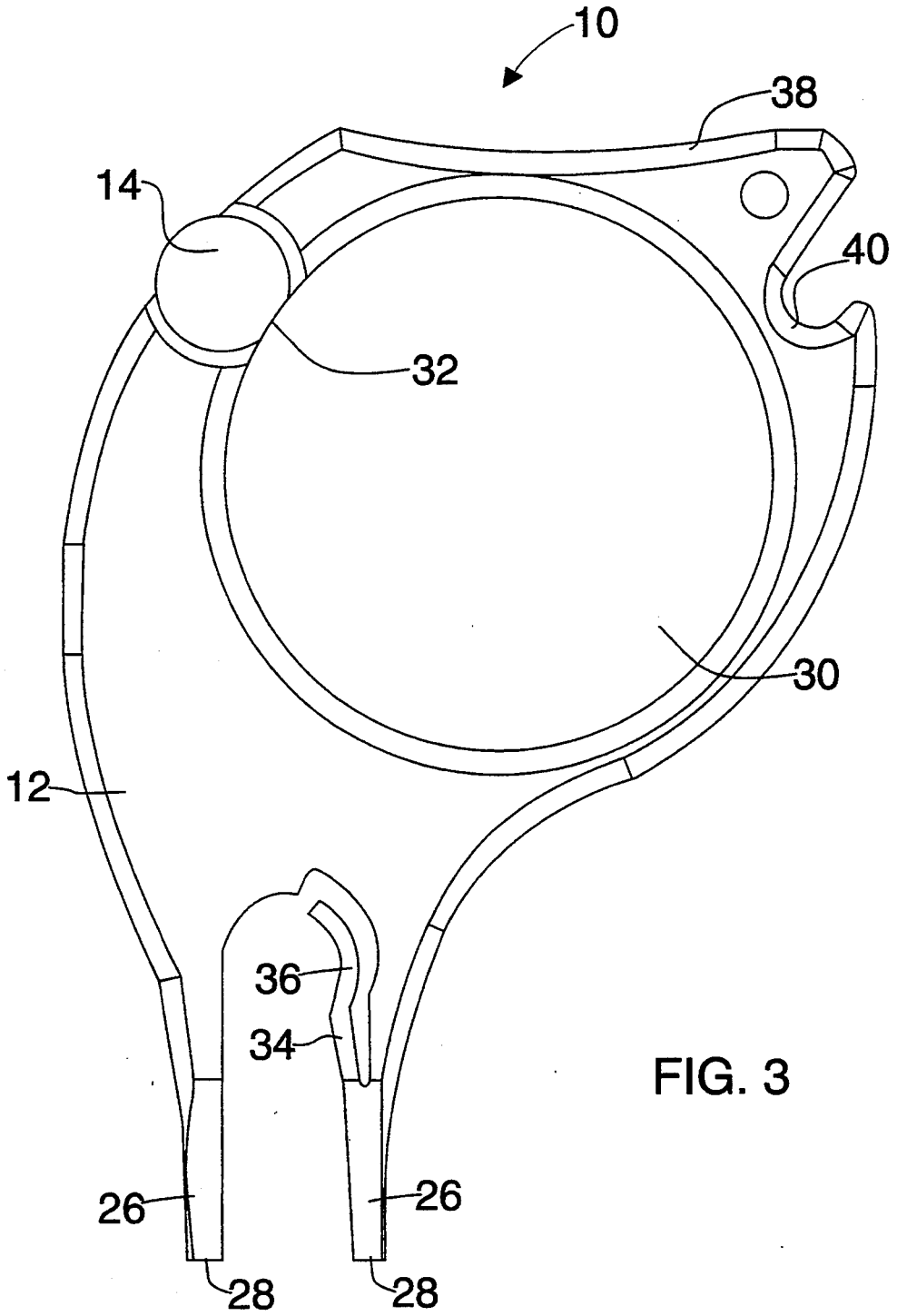
FIG. 3 is a plan view of the fully assembled tool.
Figure 4:
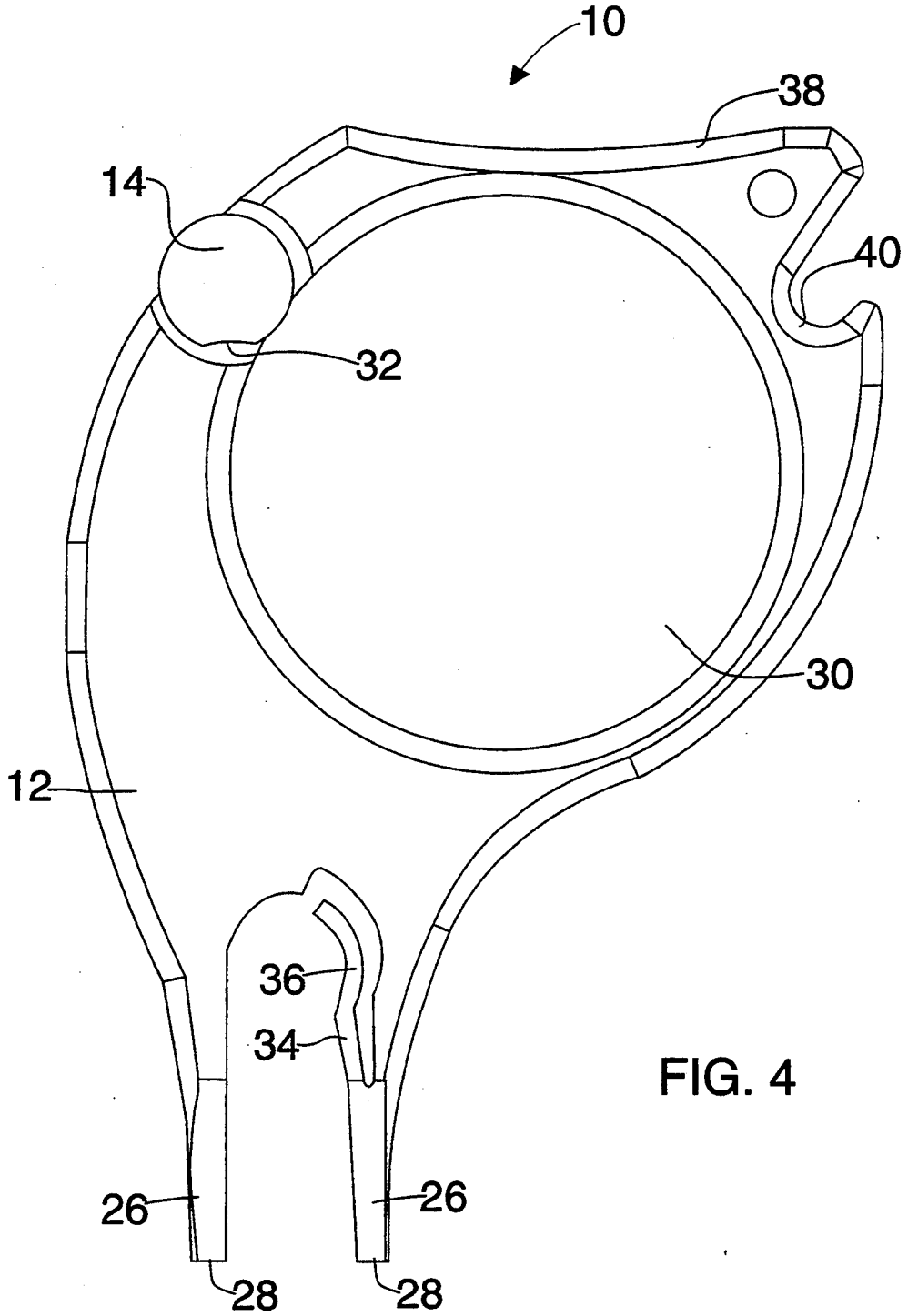
FIG. 4 is also a plan view of the tool, but showing the circular hole therethrough partially obstructed.

Before turning to FIGS. 3 and 4, which will clearly show the manner of operation of the present invention, it will be noted that the golf tool 10 has two fingers 26 extending from its plate-like body 12. The fingers 26 narrowingly taper to moderately sharp edges 28, which may align with one another as shown in FIG. 2.

Turning to FIGS. 3 and 4, which are most appropriately discussed together, the plate-like body 12 of the tool 10 has a circular hole 30 of diameter and circumference substantially equal to those of a golf ball.

It will be noted, particularly in FIG. 4, that the button 14, having the shape of a round disc, is disposed on the plate-like body 12 in a position whereby it overlaps a portion of the circumference of the circular hole 30. It will be readily understood and appreciated that a golf ball will not be able to pass through the circular hole 30, having a substantially identical diameter and circumference, when the button 14 has been rotated about its axis, which is the post 16 disposed in the hole 22, into a position such as that shown in FIG. 4.

On the other hand, when the button 14 is in the position shown in FIG. 3, a golf ball will readily pass through the circular hole 30. This is because the button 14 has a cut-out portion 32 at least substantially equal in shape and area to the amount by which the button 14 overlaps the circular hole 30. When the button 14 is rotated to the position shown in FIG. 3, a golf ball will freely pass through the circular hole 30.

Referring now to either of FIGS. 3 and 4, two fingers 26 extend from the plate-like body 12 substantially parallel to one another in the manner of the tines of a fork. One of the two fingers 26 has a resilient snap 34 extending inward within the space between the two fingers 26 toward the plate-like body 12. The resilient snap 34 has a concavely rounded portion 36 facing the other of the two fingers 26, so that the shaft of a golf club may be snappingly held thereagainst when snapped into the concavely rounded portion 36.

Because the fingers 26 are moderately sharp, the golf tool 10 may be stuck into the grounds in an upright position. In such a position, a flattened portion 38 of the plate-like body 12 will be on top away from the surface of the ground. Similarly, slot 40 will also be on top, substantially away from the surface of the ground.

One skilled in the art, as well as the relatively uninitiated to the game of golf, will now readily appreciate the value of the present golf tool 10. To check the roundness, or, more specifically, the sphericality of a golf ball, one need only pass the ball through the circular hole 30 with the button 14 in the position shown in FIG. 3.

To retrieve a golf ball from a relatively inaccessible position, such as the bottom of a shallow stream, river or pond on the golf course, one need only turn the button 14 to the position shown in FIG. 4, snap the golf tool 10 onto the shaft of a golf club, reach for the golf ball with the club, and maneuver the ball into the partially obstructed circular hole 30 so that it may be cradled therewithin, and raised from its watery lie.

The edges 28 of the fingers 26 may be used to clean the grooves on the face of a golf club by scraping any hardened dirt therefrom, and the fingers 26 may also be used to repair ball marks on greens.

When the tool 10 is inserted into the ground in an upright position with fingers 26 first, the flattened portion 38 may be used as a club grip rest to keep same above any wet grass. With the tool 10 in the same position, a cigarette may be held by slot 40 above and away from any wet, chemically treated grass on a golf course fairway.

While a particular embodiment of the present invention has been shown and described, it is clear that various changes and modifications may be made, and it is therefore intended in the following claims to cover all modifications and changes as may fall within the true spirit and scope of the invention.

What is claimed is:

1. A game tool for a game played with a substantially spherical playing ball and a playing club having an elongated shaft and a head for striking said ball, said head having a planar face with a plurality of grooves, said game tool comprising:

a plate-like body havinga circular hole passing therethrough, said circular hole having a diameter and a circumference substantially equal to those of a playing ball, so that the spherical roundness of said playing ball or its departure therefrom may be verified by passing said playing ball through said circular hole, said plate-like body further having a snapping means for use in attaching said game tool to a shaft of a playing club;

a means for obstructing a portion of the circumference of said circular hole, so that a playing ball may be prevented from passing therethrough, and so that, when said game tool is attached to a shaft of a playing club by said snapping means, a playing ball may be cradled in the partially obstructed circular hole and retrieved from an inaccessible position and wherein said means for obstructing is a button attached to said plate-like body adjacent to and overlapping a portion of the circumference of said circular hole, said button having the shape of a disc and being rotatable about an axis through its center, said button further having a cut-out portion at least substantially equal in shape and area to the amount by which said button overlaps said circular hole, so that said button may partially obstruct said circular hole unless said cut-out portion is aligned with said circular hole.

2. A game tool as claimed in claim 1 wherein said button comprises a post projecting axially from a side thereof, and wherein said plate-like body has a hole into which said post of said button may be disposed to attach said button to said plate-like body.

3. A game tool as claimed in claim 3 wherein said post of said button has a portion of enlarged diameter, and wherein said hole in said plate-like body has a portion of reduced diameter, so that said post may be snappingly engaged within said hole when said button is attached to said plate-like body.

4. A game tool as claimed in claim 2 wherein said plate-like body includes a flattened portion on a side opposite to that of said snapping means, so that said flattened portion may be used as a playing club rest when said snapping means is inserted into the ground.

5. A game tool as claimed in claim 1 wherein said plate-like body includes a slot on a side generally opposite to that of said snapping means, so that said slot may be used to hold a cigarette when said snapping means is inserted into the ground.

6. A game tool for a game played with a substantially spherical playing ball and a playing club having an elongated shaft and a head for striking said ball, said head having a planar face with a plurality of grooves, said game tool comprising:

a plate-like body having a circular hole passing therethrough, said circular hole having a diameter and a circumference substantially equal to those of a playing ball, so that the spherical roundness of said playing ball or its departure therefrom may be verified by passing said playing ball through said circular hole, said plate-like body further having a snapping means for use in attaching said game tool to a shaft of a playing club;

a means for obstructing a portion of the circumference of said circular hole, so that a playing ball may be prevented from passing therethrough, and so that, when said game tool is attached to a shaft of a playing club by said snapping means, a playing ball may be cradled in the partially obstructed circular hole and retrieved from an inaccessible position and wherein said snapping means comprises two fingers extending substantially parallel to one another from said plate-like body, one of said two fingers having a resilient snap extending inward within the space between said two fngers toward said plate-like body, said resilient snap having a concavely rounded portion facing the other of said two fingers, so that a shaft of a playing club may be snappingly held against the other of said two fingers by said concavely rounded portion of said resilient snap.

7. A game tool as claimed in claim 6 wherein at least one of said two fingers narrowingly tapers in thickness to an edge at the end thereof, so that said at least one of said two fingers may be used to clean said plurality of grooves on said planar face of said head of said playing club.

8. A game tool as claimed in claim 7 wherein both of said two fingers narrowingly taper in thickness to an edge at the end thereof.

9. A game tool as claimed in claim 8 wherein said edges of said two fingers are substantially aligned with one another, so that both fingers may be used simultaneously to clean a single one of said plurality of grooves on said planar face of said head of said playing club.

10. A game tool as claimed in claim 6 wherein said plate-like body is integrally injection molded from a synthetic polymeric material.

11. A game tool as claimed in claim 10 wherein said synthetic polymeric material is a polycarbonous plastic.

12. A game tool for a game played with a substantially spherical playing ball and a playing club having an elongated shaft and a head for striking said ball, said head having a planar face with a plurality of grooves, said game tool comprising:

a plate-like body having a circular hole passing therethrough, said circular hole having a diameter and a circumference substantially equal to those of a playing ball, so that the spherical roundness of said playing ball or its departure therefrom may be verified by passing said playing ball through said circular hole, said plate-like body further having a snapping means for use in attaching said game tool to a shaft of a playing club;

a means for obstructing a portion of the circumference of said circular hole, so that a playing ball may be prevented from passing therethrough, and so that, when said game tool is attached to a shaft of a playing club by said snapping means, a playing ball may be cradled in the partially obstructed circular hole and retrieved from an inaccessible position, wherein said means for obstructing is a button attached to said plate-like body adjacent to and overlapping a portion of the circumference of said circular hole, said button having the shape of a disc and being rotatable about an axis through its center, said button further having a cut-out portion at least substantially equal in shape and area to the amount by which said button overlaps said circular hole, so that said button may partially obstruct said circular hole unless said cut-out portion is aligned with said circular hole and said plate-like body and said button are integrally injection molded from a synthetic polymeric material.

13. A game tool as claimed in claim 1 wherein said synthetic polymeric material is a polycarbonous plastic.

* * * * *